US005775770A

United States Patent [19]

Tunney

[11] Patent Number: 5,775,770

[45] Date of Patent: Jul. 7, 1998

[54] PORTABLE BABY CARRIER

[76] Inventor: John P. Tunney, 1410 Calle Violeta, Thousand Oaks, Calif. 91360

[21] Appl. No.: 756,201

[22] Filed: Nov. 25, 1996

[51] Int. Cl.[6] ..... A47C 31/00

[52] U.S. Cl. ..... 297/183.1; 224/158; 297/183.4

[58] Field of Search ..... 297/183.1, 183.4, 297/183.6; 224/158, 159, 222; 294/140, 25

[56] References Cited

U.S. PATENT DOCUMENTS

| | | | |
|---|---|---|---|
| 1,557,263 | 10/1925 | Millen | 297/183.6 X |
| 1,625,038 | 4/1927 | Love | 294/140 X |
| 3,781,052 | 12/1973 | Millington | 294/25 |
| 4,516,806 | 5/1985 | McDonald . | |
| 4,721,321 | 1/1988 | Haury et al. | 297/183.4 X |
| 4,815,639 | 3/1989 | Lehman | 294/140 X |
| 4,888,846 | 12/1989 | Natale | 294/25 X |
| 4,924,571 | 5/1990 | Albertson | 224/222 X |
| 4,993,766 | 2/1991 | Sutherland | 294/25 X |
| 5,011,221 | 4/1991 | Wise . | |
| 5,085,486 | 2/1992 | Johnson | 297/183.1 X |
| 5,207,475 | 5/1993 | Payne . | |
| 5,409,292 | 4/1995 | Kain et al. . | |
| 5,540,365 | 7/1996 | LaMair | 224/158 |

*Primary Examiner*—Peter M. Cuomo
*Assistant Examiner*—Stephen Vu

[57] ABSTRACT

The [unilaterally functioning,] single arm infant carrier is a combination of elements creating a cantilevered effect such that the user is allowed to support the full weight of the carrier while keeping his/her arm in a more mechanically efficient position, close to the body. The single, upstanding arm may be released from and connected to either side of infant carrier so that the carrier may be supported with either arm of user. The upper end of the arm bears a support cuff which provides a weight bearing surface onto the forearm of the user. Both sides of the front portion of the carrier have a hand grip opening to receive the hand of the user as it extends downwardly and forwardly through the cuff of the single arm. Contoured hip pads are provided on either side of the carrier for an additional weight bearing surface.

9 Claims, 1 Drawing Sheet

PORTABLE BABY CARRIER

BACKGROUND OF THE INVENTION

1. Field of the Invention

The present invention generally relates to carrying means and more particularly to an improved type of baby carrier.

2. Prior Art

Various types of baby carriers have been devised which permit a baby to be carried in a tray or the like and which can be placed on a car seat. See, for example, U.S. Pat. No. 5,011,221 to Wise. The Wise device includes a carrying handle which has an inverted U-shape, the lower ends of which handle are pivotally connected to opposite sides of a baby-supporting tray. The cross-bar handle extends transversely over the tray.

When it is desired to carry the baby in the Wise carrier, the handle is raised so that the transverse cross-bar of the handle can be gripped in one hand. In order to so grip the handle, the wrist must be rotated into a horizontal plane above the transverse bar. This is an unnatural position and produces stress, particularly when the carrier itself is heavy and/or the carrying must be conducted for a long period of time. This is a formidable problem for women who do not have unusually strong arms.

The Wise carrier has the additional stress-producing problem of requiring the person carrying the baby in the Wise carrier to extend his or her arm laterally outwardly in order to grip the handle. This is awkward and tiring.

The baby carriers of U.S. Pat. Nos. 5,207,576, 4,516,806, 5,385,387 and 5,409,292 are all similar in construction and stress-producing problems to the Wise baby carrier in that they all employ inverted U-shaped carrying handles with the gripping portion extending directly over the carrying tray.

Accordingly, there is a need for an improved form of portable baby carrier which is easy to carry, does not produce muscle stress during carrying and is simple, inexpensive and durable. Such carrier should be capable of being used by both right-handed and left-handed persons.

SUMMARY OF THE PRESENT INVENTION

The improved portable baby carrier of the present invention satisfies all the foregoing needs. The carrier is simple in construction, easy to use, inexpensive, durable and equally adaptable for right-handed and left-handed persons. The carrier safely cradles the baby in a protected position against the hip of the person carrying the baby and most importantly allows the carrying to be conducted without stressing the arm or wrist muscles. The carrying arm is held in a natural strain-free position downwardly and forwardly and close to the body of the person carrying the baby and the wrist does not have to be rotated in order to properly grip the carrier for carrying.

The carrier comprises a baby-supporting, generally horizontally extending tray having a generally closed bottom, upraised opposite sides and back and an open top. The tray has an integral rear portion, intermediate portion and front portion. The tray can be made of strong light weight material, such as plastic, hardened rubber, aluminum or the like.

The carrier also includes an upstanding post having a lower end slideably received within a sleeve connected to one side of the tray's intermediate portion. A second such sleeve can be secured to the opposite side of the intermediate portion of the tray so that the post can be inserted in either sleeve to accommodate persons who are right-handed and those who are left-handed. The lower portion of the post is releasably locked into the sleeve, as by one or more cross-pins extending through alignable openings in the sleeve and post. The vertical position of the post can be adjusted, because of the vertically spaced sets of transverse openings in the lower portion of the post. The upper end of the post extends above the level of the tray and bears a support cuff, preferably in the form of a flexible resilient C-shaped tube through which the forearm of the person carrying the carrier extends. In one embodiment the cuff comprises a strap, the free ends of which bear releasable connectors.

The cuff is preferably pivotally connected to the post top for horizontal rotation around the post and for partial rotation downwardly to maintain the natural position of the forearm during carrying. The front portion of the tray on the side bearing the post has a handle which preferably is in the form of a contoured opening which permits gripping thereof without rotating the wrist. Preferably, grip openings are provided on both sides of the front portion of the tray for right-handed and left-handed use.

The improved carrier allows the person carrying the baby to extend the forearm downwardly and forwardly and hold the carrier grip, all without rotating the arm or wrist and all in a natural stress-free condition so that extended carrying of the baby can be carried out without producing muscle strain.

The post and sleeve can be of plastic, hardened rubber, metal or the like and the entire carrier can be made both durable and light in weight at very low cost. The sleeve can be secured either to the outer surface or the inner surface of the side of the intermediate portion.

Various other features of the improved baby carrier of the present invention are set forth in the following detailed description and accompanying drawings.

DRAWINGS

DETAILED DESCRIPTION OF THE PRESENT INVENTION

Figure 1:
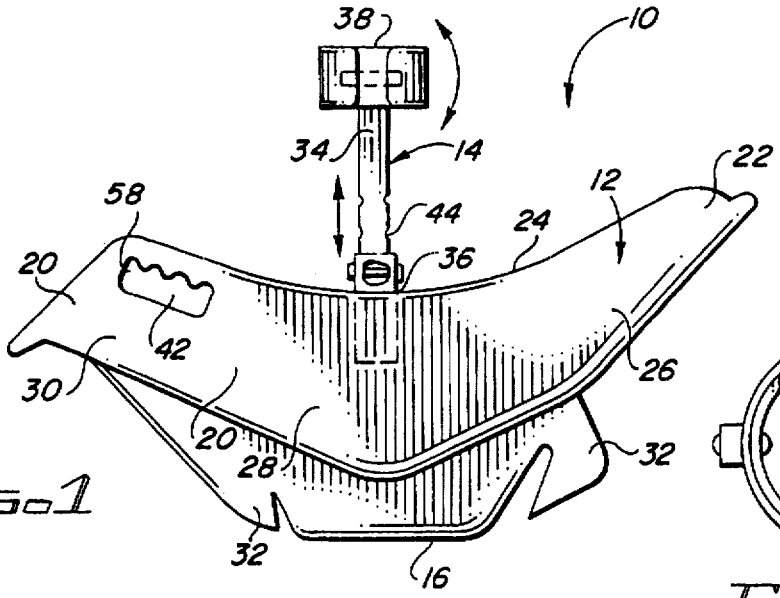
FIG. 1 is a schematic side elevation of a preferred embodiment of the improved portable baby carrier of the present invention.
Figure 3:
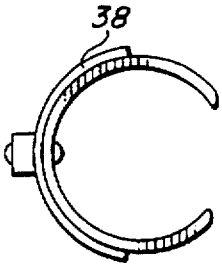
FIG. 3 is a schematic top plan view of the cuff of FIG. 1.

FIGS. 1, 2, 3, 5 and 6:

Now referring more particularly to FIGS. 1–3, 5 and 6 of the drawings, a preferred embodiment of the improved portable baby carrier of the present invention is schematically depicted therein. Thus, carrier 10 is shown, which comprises a baby-supporting tray 12 and carrying means 14.

Tray 12 supports a baby when it is in carrier 10. Tray 12 comprises a curved or contoured, generally horizontally extending structure having a generally closed bottom 16, upraised opposite sides 18 and 20, an upraised back 22 and an open top 24. Tray 12 has a rear portion 26, an intermediate portion 28 and a front portion 30. Preferably, tray 12 is fabricated in one piece from smooth, strong and light plastic, hardened rubber, metal such as aluminum or the like. The bottom 16 of tray 12 is flat so that tray 12 will rest securely on a flat surface. Support struts or legs generally designated 32 help to reduce the weight of tray 12 while supporting it above or against a flat surface.

Carrying means 12 comprises, in combination, an upstanding post 34, a post-retaining sleeve 36, a support cuff 38 secured, preferably pivotally secured, to the upper end 40 of post 34 and a hand grip 42 in the side 18 of front portion 30 of tray 12, that is, on the same side to which post 34 is connected.

Figure 2:
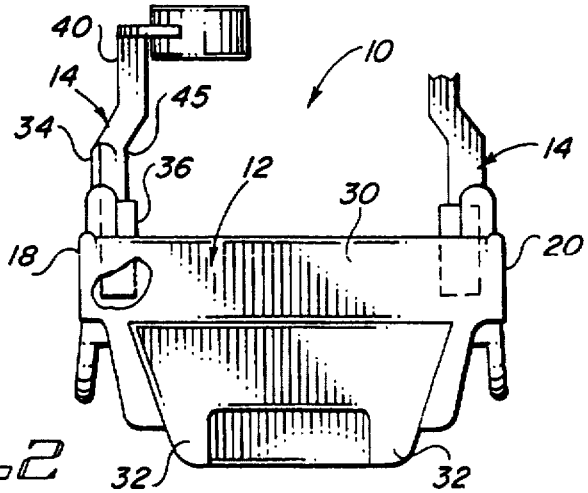
FIG. 2 is a schematic front elevation, partly broken away, of the carrier of FIG. 1.

In FIGS. 1 and 2, post 34 is shown connected to side 18. FIG. 2 also shows a second post 34 secured to side 20 of front portion 30. It will be understood that the same post 34 can be used on both sides 18 and 20 merely by removing it from said sides and moving it over to the other of said sides.

Retaining sleeve 36 is shown in both FIGS. 1 and 2 as being connected to the inner surface of the intermediate portion 28. It will be understood that, if desired, sleeve 36 could be connected to the outer surface of portion 28. A second identical sleeve 36 is shown in FIG. 2 for insertion of the single post 34 or a second identical post 34.

Sleeve 36 is a hollow vertical, preferably cylindrical, tube within which the lower end 44 of preferably cylindrical post 34 is slideably received and releasably locked therein by a cross-pin 46 which releasably extends transversely through aligned transverse openings 48 in post 34 and openings 50 in sleeve 36. Lower end 44 of post 34 is preferably provided with vertically spaced sets of openings 48 so that the relative vertical height of post 34 can be adjusted in sleeve 36 by cross-pin 46.

Post 34 can have an offset intermediate portion 45, if desired, interconnecting the upper end 40 of post 34 to the lower end 44 thereof into a unitary whole. The upper end 40 of post 34 extends well above top 24 and sides 18 and 20, as shown in FIGS. 1 and 2. It bears a bracket 52 which at one end 54 thereof is preferably pivoted to post 34 so that cuff 38 can swing in a horizontal plane, while the opposite end 56 of bracket 52 is secured to cuff 38, permitting cuff 38 to tilt up or down, preferably through a limited range of, for example, about 10 degrees. This arrangement facilitates properly aligning a person's forearm when extended through cuff 38 downwardly and forwardly toward hand grip 42.

Hand grip 42 preferably comprises a contoured opening 58 defining a plurality of finger spaces 60 and a palm space. It will be understood that a separate hand grip 42 can be provided in each of the two opposite sides 18 and 20 in front portion 30, so as to be able to install post 34 either on the left side or the right side of carrier 10 and properly hold grip 42 after passing the forearm through cuff 38.

Accordingly, carrier 10 is simple, durable, efficient and effective to reduce or eliminate stress and strain while carrying a baby. The carrying forearm is always kept, as is the hand, in a natural relaxed position for maximum comfort.

Figure 4:
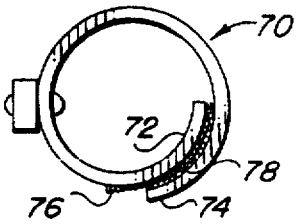
FIG. 4 is a schematic top plan view of an alternative form of the cuff of the carrier of the present invention.
Figure 5:
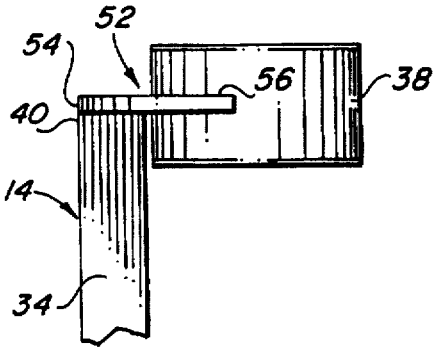
FIG. 5 is a schematic is a schematic enlarged fragmentary side elevation of the cuff of FIG. 1 and its connection to the top of the post of FIG. 1; and, FIG. 6 is a schematic enlarged fragmentary side elevation, partly broken away, of the lower end of the post and of the sleeve and cross pin releasably locking the post and sleeve together in the embodiment of FIG. 1.
Figure 6:
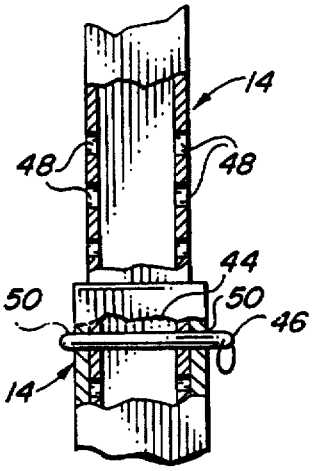

FIG. 4:

An alternative embodiment of the cuff utilized in the baby carrier of the present invention is schematically depicted in FIG. 4. Thus, cuff 70 is shown which can be substituted for cuff 42, if desired. Cuff 70 comprises a flexible resilient strap of cloth, leather, etc., secured at about its mid-point to a bracket (not shown) identical to bracket 52. The opposite ends 72 and 74 of cuff 70 bear releasable securing means such as a plurality of spaced hooks 76 on the inner surface of end 74 and hook-receiving loops 78 on the outer surface of end 72, so that the effective size of cuff 70 can be readily adjusted. Other securing means such as spaced buttoms and button receivers, or spaced hooks and eyes (not shown) could be used in place of hooks 76 and loops 78.

Various other modifications, changes, alterations and additions can be made in the improved baby carrier of the present invention, its components and parameters. All such changes, modifications, alterations and additions as are within the scope of the appended claims form part of the present invention.

What is claimed is:

1. A single-arm infant carrier having a tray carrying means comprising:

a) a generally horizontally extending tray having generally vertical side walls, a back, and an open top, whereby said tray forming a rear portion, an intermediate portion, a front portion, and an interior portion;

b) a cantilevered tray carrying means comprising, in combination:

I. a single, removable, adjustable upstanding post having a lower section connected to one of two opposite integral tubular sleeves at the intermediate portion of said tray for reception of said post to permit either left or right hand use of said tray carrying means, said post having a lower section oriented vertically to said tray, an intermediate section oriented vertically and medially from an upper end of the lower section of said post toward the interior portion of said tray, and an upper section of said post oriented vertically from an upper end of the intermediate section;

ii. a forearm attachment means attached to the upper, medial section of said post, said forearm attachment means adaptable to receive the forearm of a right or left hand user, said forearm attachment means permitting said forearm to extend downwardly and forwardly to facilitate carrying of said tray, said forearm attachment means pivotally connected to said post for partial movement in vertical and horizontal planes to facilitate angling of said forearm toward said grip;

iii. an integral hand grip on both of the side walls to permit a person to hold said grip after extending an arm through said forearm attachment means, facilitating the support of said infant carrier in a natural downwardly strain-free arm position; and, iv. an integral hip pad positioned on each of said sidewalls of said intermediate portion of said tray, said pad to provide a weight bearing surface as said pad contacts with the hip of a user, thereby reducing stress of the weight of said tray to the arm of the user.

2. The single arm infant carrier of claim 1, wherein said forearm attachment means is a flexible, resilient C-shaped cuff so as to fit various forearms.

3. The single arm infant carrier of claim 1, wherein the lower portion of said post is slidably received into one of a pair of opposite, integral tubular sleeves of said intermediate portion of said tray and wherein said post and said sleeve contain means for releasably locking said post at pre-selected heights within said sleeve to accommodate varying physical proportions of the forearm of the user carrying said carrier.

4. The single arm infant carrier of claim 3, wherein said locking means comprise a plurality of vertically spaced transverse openings in the lower section of said post, and at least one transverse opening in said sleeve alignable with a pre-selected one of said post openings to releasably hold said post at a pre-selected height.

5. The single arm infant carrier of claim 1, wherein said grip comprises an opening on each side of said frontal portion of said tray through which a human hand fits.

6. The single arm infant carrier of claim 1, wherein said tray has a plurality of bottom support legs and a flat bottom, and wherein said hand grip comprises an opening defined by a plurality of finger notches to facilitate firm gripping.

7. A single arm infant carrier adapted to be carried by an individual at his/her side with one arm, comprising:

a) a base portion with a plurality of bottom support legs and a semi-flat bottom;

b) a support member slidably received into one of a pair of integral tubular sleeves of an intermediate portion of said base portion and extending upwardly therefrom, said support member is extendable, c) a receptacle member connected to said support member adapted to receive the forearm of an individual, wherein said support member is a cuff pivotally connected to said post for partial movement in vertical and horizontal planes to facilitate angling of said forearm toward said grip;

d) a hand grasping portion comprising of a plurality of finger notches secured to each side of said base portion; and, e) an integrated semi-flattened surface at an intermediate portion of said tray.

8. The single arm infant carrier of claim 7, wherein said hand grasping portion may also take the form of a single, inverted U-shaped, transverse handle extending over a frontal portion of the carrier and attached to each side of said carrier.

9. The single arm infant carrier of claim 7, wherein said semi-flattened surface is contoured to fit the side of a person at the hip location.

* * * * *